United States Patent [19]

Meiller et al.

[11] Patent Number: 4,743,065

[45] Date of Patent: May 10, 1988

[54] ADJUSTABLE SEAT

[75] Inventors: Hermann Meiller; Wolfram Jahn, both of Amberg, Fed. Rep. of Germany

[73] Assignee: Grammer Sitzsysteme GmbH, Amberg, Fed. Rep. of Germany

[21] Appl. No.: 48,375

[22] Filed: May 11, 1987

[30] Foreign Application Priority Data

May 24, 1986 [DE] Fed. Rep. of Germany ..... 3617539

[51] Int. Cl.[4] ..... A47C 1/024; A47C 3/026

[52] U.S. Cl. ..... 297/300; 74/471 XY; 297/301; 297/306; 297/316; 297/328

[58] Field of Search ..... 297/300, 301, 306, 325–328, 297/316, 320, 337, 344, 355; 74/471 R, 471 XY; 248/631

[56] References Cited

U.S. PATENT DOCUMENTS

| | | | |
|---|---|---|---|
| 4,364,605 | 12/1982 | Meiller | 297/300 X |
| 4,408,800 | 10/1983 | Knapp | 248/631 X |
| 4,537,445 | 8/1985 | Neuhoff | 297/300 |
| 4,589,697 | 5/1986 | Bauer et al. | 297/300 |
| 4,629,249 | 12/1986 | Yamaguchi | 297/300 |

FOREIGN PATENT DOCUMENTS

| | | | |
|---|---|---|---|
| 2855915 | 6/1980 | Fed. Rep. of Germany | 297/300 |

*Primary Examiner*—Kenneth J. Dorner
*Assistant Examiner*—Peter R. Brown
*Attorney, Agent, or Firm*—Louis E. Marn

[57] ABSTRACT

A seat such as an office chair comprises a seat carrier assembly carrying an adjustable seat portion and also an adjustable backrest portion. The inclination of the backrest portion can be adjusted by means of a first gas spring unit while inclination of the seat portion is adjusted by means of at least one and preferably two second gas spring units. An actuating lever is operatively connected to the valve actuating members of the respective gas spring units and is pivotable about a pivot point in first and second directions, the second direction being at least substantially perpendicular to the first direction. The actuating lever is pivotable in the first direction for adjusting backrest inclination only and is pivotable in the second direction for adjusting seat portion inclination only, and it can be pivoted in the first direction when it is selectively at first and second spaced-apart positions as considered in the second direction of its movement, to permit combined movement of the seat and backrest portions.

5 Claims, 2 Drawing Sheets

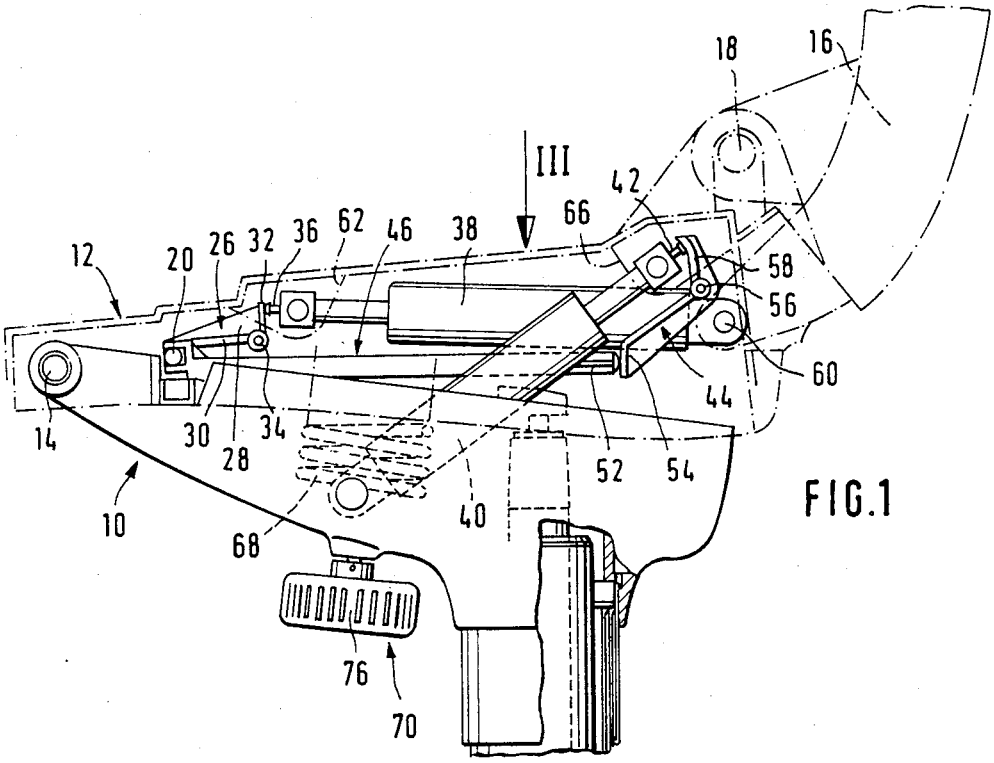
FIG.1
FIG.2
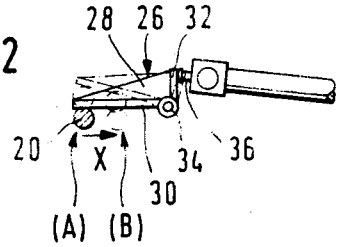
FIG.5
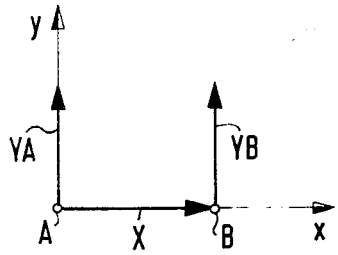

ADJUSTABLE SEAT

BACKGROUND OF THE INVENTION

One form of seat having an adjustable seat portion and a backrest portion which is adapted to be adjusted in respect to its angle of inclination, for example an office chair, comprises a seat carrier assembly on which is carried a seat portion which is adjustable in regard to its angle of inclination, together with a backrest portion which is also adjustable in its angle of inclination. The seat comprises a first gas spring unit which is connected to the backrest portion for adjusting the inclination thereof and at least one further gas spring unit which is operatively connected to the seat portion for adjusting the inclination of the seat portion. An actuating lever is operatively connected to the valve actuating pins of the gas spring units, by way of a suitable connecting system, and the actuating lever is pivotable about a pivot point in a first direction and also in a second direction which is perpendicular thereto, for producing the respective adjustment movements. Such a seat is to be found for example in EU patent application No. 0 022 933.

In that seat, pivotal movement of the actuating lever in the first direction makes it possible to adjust the angle of inclination of the seat portion of the seat or, by returning the lever by way of the starting position thereof, the angle of inclination of the backrest portion. Pivoting the actuating lever in the second direction provides for joint pivotal movement of the seat portion and the backrest portion to adjust the angles of inclination thereof in combination. Therefore, that seat construction makes it possible to pivot either only the seat portion or only the backrest portion, as desired, or it can provide that the seat portion and the backrest portion can only be jointly pivoted for adjustment as a unit.

SUMMARY OF THE INVENTION

An object of the present invention is to provide a seat such as an office chair having an adjustable seat portion and an adjustable backrest, which provides for enhanced ease of operation.

Another object of the invention is to provide a seat having adjustable seat and backrest portions, which provides for a greater degree of versatility in regard to adjustment of the seat and backrest portions.

Still another object of the present invention is to provide a seat having adjustable seat and backrest portions, wherein the inclination of the seat portion and the inclination of the backrest portion can be adjusted in succession with a sequence of movements which are easy to perform.

Still a further object of the present invention is to provide an office chair having an adjustable seat portion and an adjustable backrest portion, wherein adjustment of one said portion by means of an actuating member can be followed by adjustment of the second said portion by means of the same actuating member without the need for the actuating member to be returned to an initial position after adjustment of the first said portion and before adjustment of the second said portion.

In accordance with the present invention, those and other objects are achieved by a seat such as an office chair comprising a seat carrier with a seat portion which is carried on the seat carrier and which is adjustable in respect of its angle of inclination, and a backrest portion which is also adjustable in respect of its angle of inclination. A first gas spring unit is operatively connected to the backrest portion for adjustment thereof and at least one second gas spring unit is operatively connected to the seat portion also for adjustment thereof. An actuating lever can actuate the valve actuating members of the respective gas spring units by way of suitable connecting members, wherein the actuating lever is pivotable about a pivot in a first direction and in a second direction perpendicular to the first direction. The actuating lever is operable to adjust only the angle of inclination of the backrest portion when the actuating lever is pivoted in the first direction and only the angle of inclination of the seat portion when the actuating lever is pivoted in the second direction. The actuating lever is such that it can be adjusted in the first direction of movement thereof, when it is in respective ones of first and second spaced-apart positions in the second direction of pivotal movement thereof.

As will be seen in greater detail hereinafter in connection with a preferred embodiment of the seat according to the present invention, the adjustability of the actuating lever in two spaced-apart positions in relation to the second direction of movement thereof, for movement in the first direction, permits the actuating lever to be displaced in the first direction when it is in the first of the positions in relation to the second direction of movement, thereby to provide for adjustment of the angle of inclination of the backrest. To adjust the inclination of the seat portion, the actuating lever is moved in the second direction of movement, from the first position to the second position in that direction. Adjustment of the inclination of the seat portion, in the seat in accordance with the present invention, involves not just static setting of a desired angle of inclination of the seat portion, but also the possibility of a dynamic change in the angle of inclination of the seat portion, that is to say, the option of performing a tilting movement with the seat. By pivoting the actuating lever in the first direction of movement thereof, when the actuating lever is set to the second position as considered in the second direction of movement, it is possible to adjust the angle of inclination of the backrest portion independently of the angle of inclination of the seat portion or while the seat portion is also being moved, as desired.

In a preferred feature of the invention, the connecting arrangement connecting the actuating lever to the valve actuating pin member of the first gas spring unit which provides for adjusting the inclination of the backrest portion includes a first connecting member which, when the actuating lever is displaced in the first direction when set in either one of the first and second positions as considered in the second direction of movement, provides for actuation of the valve actuating member of the first gas spring unit while displacement of the actuating lever in the second direction of movement does not cause the valve actuating pin member of the first gas spring unit to be actuated. The connecting arrangement further includes a second connecting member between the actuating lever and the second gas spring unit for adjusting the angle of inclination of the seat portion or for permitting a tilting movement thereof, the arrangement of the second connecting member being such that only displacement of the actuating lever in the second direction causes actuation of the actuating pin member of the second gas spring unit. In such a seat, the first connecting member may comprise a pivotably mounted angle lever having first and second limb portions, wherein the actuating lever bears against or co-operates with the first limb portion which is arranged in the second direction of movement of the lever and is displaceable along the first limb portion in order to actuate the valve actuating pin member of the second gas spring unit. The second limb portion of the angle lever, which extends in the second direction of movement of the actuating lever, bears against or co-operates with the valve actuating pin member of the first gas spring unit. That construction, with a pivotable angle lever, permits the actuating lever to be displaced along the first limb portion of the pivotably mounted angle lever from the first position as considered in the second direction of movement of the lever, into the second position which is at a spacing therefrom, for the purposes of adjusting the inclination of the seat portion or for permitting rocking movement thereof. In that situation, the actuating lever is not displaced in its first direction of movement so that the angle lever does not perform any pivotal movement about its pivot axis. That means that the valve actuating pin member of the first gas spring unit is not actuated and the angle of inclination of the backrest portion remains unaltered. During movement of the actuating lever from the first position in the second direction of movement thereof, into the second position, only the valve actuating member of the second gas spring unit is operated, thereby to permit adjustment of the angle of inclination of the seat portion. On the other hand, pivotal movement of the actuating lever when it is set in its first position as considered in its second direction of movement or in its second position in said direction of movement, with such pivotal movement of the actuating lever occurring in the first direction of movement thereof, causes pivotal movement of the angle lever about its pivot axis and thus causes operation of the valve actuating pin member of the first gas spring unit, with which the above-mentioned second limb portion of the angle lever co-operates. In that way the inclination of the backrest portion of the seat can be adjusted as desired when the actuating lever is moved in its first direction of movement, both when it is set in its first position and when it is set in its second position as considered in its second direction of movement. If the actuating lever is in its first position in relation to its second direction of movement, the angle of inclination of the backrest portion can be adjusted as desired, by displacing the actuating lever in the first direction of movement, without the seat portion being capable of performing a tilting movement. If however the actuating lever is in the second position in relation to the second direction of movement thereof, being a position in which the actuating lever can be adapted to be arrested if required, then, upon pivotal movement of the actuating lever in the first direction of movement thereof, it is possible to adjust the inclination of the backrest portion while at the same time it is also possible to perform a tilting movement with the seat portion. In that way the seat according to the present invention provides that the angle of inclination of the backrest portion can be individually adjusted during the tilting or rocking movement of the seat portion.

The pivot axis at which the angle lever is pivotally mounted is preferably carried on the seat portion while the end portion of the first gas spring unit, which is remote from the end carrying the valve actuating pin member therof, is preferably disposed at the backrest portion and the end portion of that gas spring unit, at which the valve actuating pin member is disposed, is preferably disposed at the seat portion. Arranging the pivot mounting axis of the angle lever on the seat portion excludes relative movement between the seat portion and the angle lever so that actuation of the first gas spring unit for adjusting the inclination of the backrest portion is independent of the respective angle of inclination or a tilting movement of the seat portion.

The second connecting member referred to above may comprise a forked element having a shank portion and first and second leg portions. Each leg portion may engage a first lever arm of a pivotably mounted elbow lever whose second lever arm co-operates with the valve actuating pin member of the second gas spring unit. The seat may have two second gas spring units and a said second gas spring unit may thus be associated with each of the two leg portions of the forked element. The two second gas spring units are arranged at a spacing from each other between the seat portion and the seat carrier assembly. By virtue of the second connecting member comprising the forked element as referred to above, the invention provides a symmetrical structure and good lateral stability for the seat portion relative to the seat carrier assembly of the seat according to the invention. The seat portion can be pivoted or tilted relative to the seat carrier assembly about an axis which is at a spacing from the two mutually aligned axes of the two second gas spring units, about which the end portions of the second gas spring units remote from the ends having the valve actuating pin members are pivotable, with those axes being mounted in a stationary condition to the seat carrier assembly. The above-mentioned spacing thus defines one side of an imaginary triangle. The corner of the triangle which is opposite that side is defined by the mutually aligned mountings of the valve actuating pin members of the second gas spring units or the axis of each pivotal lever which is arranged in the vicinity of such mounting means, wherein the mounting points of the valve actuating pin members of the second gas spring units and the two mutually aligned axes of the two pivotal levers are stationary in relation to the seat portion.

In a preferred embodiment of the seat according to the invention the shank portion of the forked element constituting the second connecting member referred to above may be connected to the actuating lever at a spacing from the above-mentioned angle lever. The connection of the shank portion to the actuating lever may be made by way of an end portion of the second connecting member, which is of a clamp-like configuration.

As already mentioned above, the axes of the two elbow levers are preferably aligned with each other and are stationary with respect to the seat portion.

It will be seen therefore that the seat according to the invention not only provides a high degree of seating comfort but it is also readily possible to relax therein as a result of the option of producing tilting or rocking movements when the backrest portion has been set to a given desired position.

Further objects, features and advantages of the seat according to the present invention will be apparent from the following description of a preferred embodiment thereof.

BRIEF DESCRIPTION OF THE DRAWINGS

FIG. 1 is a side view of part of a seat according to the invention, wherein the seat portion is shown in longitudinal section by broken and dash-dotted lines while the seat carrier assembly is shown as a side view and a part of the backrest portion of the seat is indicated by dash-dotted lines, FIG. 2 shows a detail from FIG. 1 showing the connecting member between an actuating lever as indicated by hatching, and the valve actuating pin member, of which part is shown, of a first gas spring unit, FIG. 5 is a diagram representing the movements of the actuating lever in a first direction y and/or in a second direction x.

DESCRIPTION OF THE PREFERRED EMBODIMENT

Figure 3:
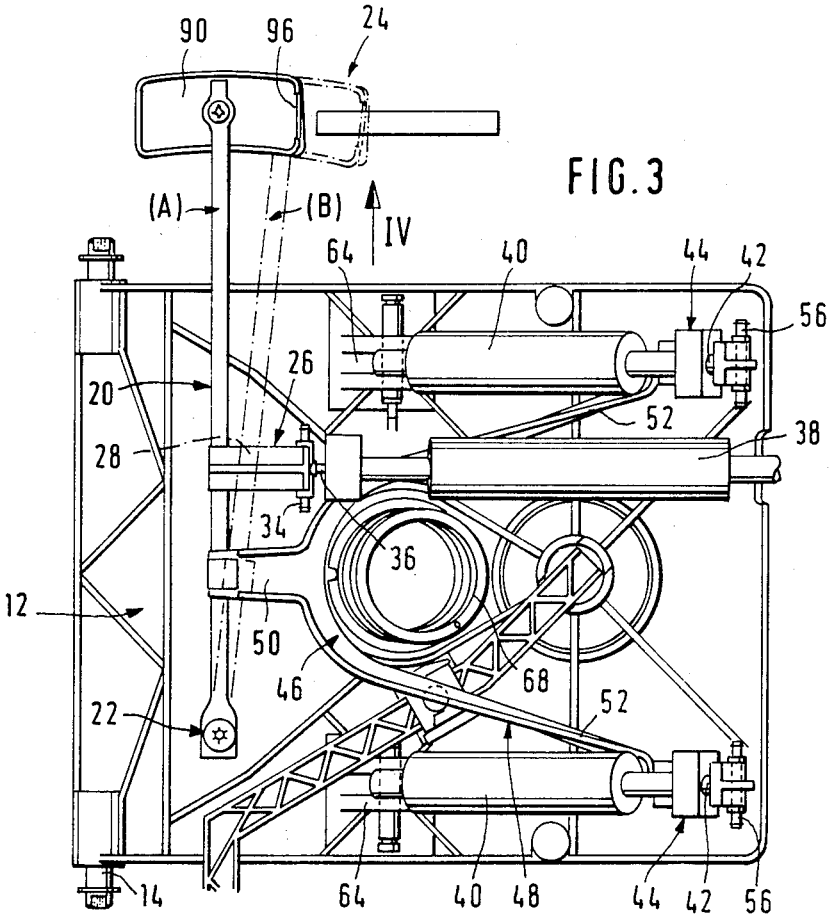
FIG. 3 is a view of the seat according to the invention looking in the direction indicated by the arrow III in FIG. 1.

Referring firstly to FIG. 1, shown therein is part of a seat such as an office chair in accordance with the present invention, comprising a seat carrier assembly 10, a seat portion 12 which is carried thereon and which is adjustable in its angle of inclination relative to the seat carrier assembly 10 by pivotal movement about an axis as indicated at 14 and about which the seat portion 12 is capable of performing a tilting or rocking movement, relative to the seat carrier assembly 10. Reference numeral 16 denotes part of a backrest portion which is indicated by dash-dotted lines. The backrest portion 16 is mounted pivotably on the seat portion 12 about an axis 18, for adjustment of the angle of inclination of the backrest portion.

Referring now additionally to FIG. 3, an actuating lever 20 is mounted to the seat portion 12 pivotably about a pivot as indicated at 22. FIG. 5 illustrates in diagrammatic form that the actuating lever 20 is pivotable about the pivot point 22 both in a first direction in space and in a second direction in space. The first direction is indicated in FIG. 5 by the ordinate y and the second direction is indicated by the abscissa x. Referring to FIG. 5, starting from a position A in the second direction x, the actuating lever 22 can be moved in the first direction y or in the second direction x. By displacing the actuating lever 20 in the first direction y, as indicated by the arrow YA, it is possible to adjust the inclination of the backrest portion 16. If the actuating lever 20 is moved from the first position A into a second position B at a spacing therefrom, in the second direction x, as indicated in FIG. 5 by the arrow X, a set angle of inclination of the backrest portion 16 remains unaltered and only the inclination of the seat portion 12 relative to the seat carrier assembly 10 is changed, or a rocking or tilting movement as between the seat portion 12 and the seat carrier assembly 10 is permitted.

Figure 4:
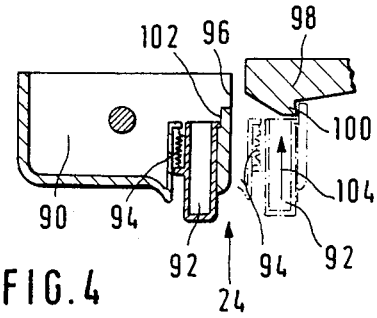
FIG. 4 is a view of the actuating lever and an arresting means for the actuating lever, looking in the direction indicated by the arrow IV in FIG. 3.

The actuating lever 20 can be fixed in the second position B as shown in FIG. 5 by an arresting means 24 which is shown in diagramatic form in FIG. 3 and also in FIG. 4. When the lever is in the second position B disposed in the second direction of movement thereof, as shown in FIG. 5, it is again possible for the actuating lever 20 to be displaced in the first direction y, as shown diagrammatically in FIG. 5 by the arrow YB. That movement of the lever 20 in the direction indicated by the arrow YB makes it possible as desired to adjust the inclination of the backrest portion 16 while setting the angle of inclination of the seat portion 12 or while performing a rocking or tilting movement thereof.

Having now set forth what might be termed the theoretical basis of the structure in accordance with the present invention, the mechanism for carrying those movements into practical effect will now be described with reference to FIGS. 1 through 3, to show the way in which adjustments of the angles of inclination of the seat portion 12 and the backrest portion 16 can be produced, with or without a simultaneous rocking or tilting movement of the seat portion.

Thus, reference numeral 26 generally denotes a connecting member which is in the form of an angle lever specifically identified by reference numeral 28. The angle lever 28 has a first limb portion 30 and a second limb portion 32. The angle lever 28 is pivotable about a pivot axis as indicated at 34, formed for example by a spindle which is mounted in a stationary position on the seat portion 12. The actuating lever 20 co-operates with the first limb portion 30 of the angle lever 28, as by bearing thereagainst, and is displaceable in the second direction of movement thereof between the first position A as shown by the hatched configuration in FIG. 2, and the second position B which is shown by the dash-dotted line configuration in FIG. 2. That displacement is indicated by the arrow X in FIG. 2. When the actuating lever 20 is displaced in that manner in the direction of the arrow X, the angle lever 28 is not pivoted about the pivot axis 34. That means that a valve actuating pin member 36 of a first gas spring unit 38 is not actuated when the actuating lever 20 is displaced in that manner in the second direction of movement thereof.

However, when the actuating lever 20 is pivoted in the second direction of movement thereof from the first position A into the second position B which is also shown in dash-dotted lines in FIG. 3, the two second gas spring units indicated at 40 and clearly visible in FIG. 3 are actuated by virtue of the valve actuating pin members 42 of the two gas spring units 40 being operatively connected to the actuating lever 20 by way of rockingly mounted elbow levers 44 and a second connecting member 46.

As shown in FIG. 3, the second connecting member 46 comprises a forked element 48 having a shank portion 50 from which extend first and second leg portions 52. The end of each leg portion 52, which is remote from the shank portion 50, co-operates with, as by bearing against, a limb portion 54 of each elbow lever 44 which is mounted pivotably about a pivot axis as indicated at 56. The pivot axes 56 of the two elbow levers 44 are aligned with each other, so that only one elbow lever 44 and only one pivot axis 56 can be seen in FIG. 1. The arrangement of the two elbow levers 44 and the two pivot axes 56 can be clearly seen however from FIG. 3.

Each elbow lever 44 has a second leg portion 58 which co-operates with the valve actuating pin member 42 of the respective second gas spring unit 40, as by bearing thereagainst. When the actuating lever 20 is pivoted in the direction indicated by the arrow X in FIG. 2, in the second direction of movement thereof, then, as will be readily apparent from FIG. 1, each of the two elbow levers 44 is pivoted in a counter-clockwise direction therein so that the second leg portion 58 of each elbow lever 44 actuates the associated valve actuating pin member 42 of the respective second gas spring unit 40, so that the angle of inclination of the seat portion can be adjusted relative to the seat carrier assembly 10 or the seat portion 12 is capable of performing a tilting or rocking movement relative to the seat carrier assembly 10, about the common axis 14.

For the purposes of adjusting the angle of inclination of the backrest portion 16, the actuating lever 20 is displaced in the first direction y as shown in FIG. 5, either when the actuating lever 20 is set in the first position A in relation to the second direction of movement x or when the actuating lever 20 is set in the second position B which is at a spacing from the first position A. Displacement of the actuating lever 20 in the first direction of movement y, as indicated by the arrow YA, when the actuating lever 20 is set to the position A, provides for pivotal movement of the angle lever 28 in a clockwise direction as viewed in FIG. 1. Such pivotal movement of the angle lever 28 causes actuation of the valve actuating pin member 36 of the first gas spring unit 38 by the second limb portion 32 of the angle lever 28 so that, by means of the first gas spring unit 38, the angle of inclination of the backrest portion 16 can be adjusted as desired, with the seat portion 12 remaining set in its adjusted condition or being in such a condition that it cannot perform a tilting or rocking movement. The first gas spring unit 38 is pivotally connected to the backrest portion 16 at a common fixing portion as indicated at 60.

When the actuating lever 20 is displaced in the first direction of movement thereof, as indicated by y in FIG. 5, in the direction indicated by the arrow YB in FIG. 5, when the lever is set to the second position B in relation to the second direction of movement x of the lever, by means of the arresting device 24, then, with the second gas spring units 40 in an actuated condition, the angle lever 28 is pivoted and the first gas spring unit 38 is actuated so that it is possible to adjust the angle of inclination of the backrest portion 16 as desired, when the seat portion 12 is capable of being adjusted in respect of its angle of inclination or is capable of performing a tilting or rocking movement.

As can be seen from FIG. 1, the first gas spring unit 38 is mounted pivotably to the seat portion 12, by means of its end portion which is towards the valve actuating pin member 36. The mounting structure for the first gas spring unit 38 is indicated in FIG. 1 by the plate member 62 shown in dash-dotted lines therein. The two gas spring units 40 are mounted to the seat carrier assembly 10 by means of their end portions remote from their valve actuating pin members 42. That mounting structure involves plate members 64 as are clearly shown in FIG. 3.

The valve actuating pin members 42 of the second gas spring units 40 are mounted by means of a mounting structure which is shown in broken lines in FIG. 1 in the form of a plate member 66. The seat comprises two such plate members 66 which are arranged in alignment with each other, being disposed one behind the other in FIG. 1, on the seat portion 12.

Disposed between the seat carrier assembly 10 and the seat portion 12 is a spring element in the form of a compression coil spring 68, the mechanical biasing of which can be adjusted as desired by means of an adjusting device indicated generally at 70 in FIG. 1. The adjusting device 70 and the mode of operation thereof can be clearly seen from FIG. 6 to which reference will now be made.

Figure 6:
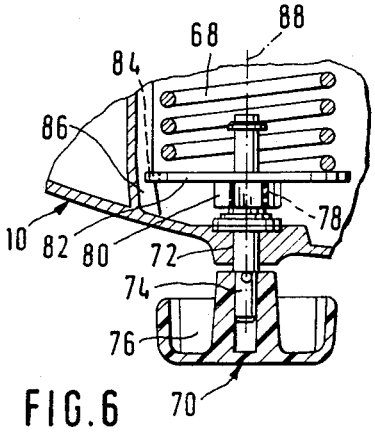
FIG. 6 is a view in longitudinal section of a part of an adjusting device for adjusting the biasing force of a spring element of the seat according to the invention.

Accordingly, FIG. 6 shows a view in longitudinal section of a part of the seat carrier assembly 10. The seat carrier assembly 10 provides a bore 72 through which extends a spindle 74 which is provided with a rotary knob 76 which is non-rotatably fixed thereon, at the end portion of the spindle 74 which projects from the seat carrier assembly 10. The spindle 74 is provided with a screwthreaded portion 78 which is screwed into a screwthreaded nut 80. The nut 80 is fixedly connected to a disc or plate 82 which is prevented from rotating relative to the seat carrier assembly 10. For that purpose, the disc 82 has a recess 84 into which projects a rib 86 carried on the seat carrier assembly 10. One end portion of the spring element 68 bears against the disc 82. Rotary movement of the knob 76 about the central longitudinal axis as indicated at 80 produces corresponding axial movement of the nut 80 with the disc 82 in the direction of the longitudinal axis 88, and thus results in a change in the overall length of the spring element 68.

Reference will now be made to FIGS. 3 and 4 showing details of the adjusting device 24 by means of which the actuating lever 20 can be fixed in the second position identified at B in FIG. 5, so that in that second position B the actuating lever can be conveniently displaced in the first direction y, as indicated by the arrow YB in FIG. 5. Thus, as shown in FIG. 4, the end portion of the lever 20, which is remote from its pivot point 22, carries an actuating knob or handle 90 which is provided with a push button 92. A spring 94 is disposed between the push button 92 and the handle 90, as clearly shown in FIG. 4. The handle 90 has an opening 96 through which a retaining or detent member 98 extends into the interior of the handle 90 when the lever 20 is displaced in the second direction of movement x thereof from the first position A into the second position B as shown in FIG. 5. The second position B is shown in dash-dotted lines in FIG. 4. In that position, an engagement portion 100 of the detent member 98 engages into the interior of the handle 90 in such a way that the portion 100 comes to bear against a support surface 102 of the handle 90. In order to release the resulting snap connection formed between the handle 90 and the detent member 92 as required the push button 92 is pressed in the direction indicated by the arrow 104 in FIG. 4 so that the detent portion 100 is moved away from the co-operating face 102 of the handle 90. When that occurs, the spring 94 is compressed so that, when the push button 92 is released again, it returns to its initial position as shown in solid lines in FIG. 4.

It will be appreciated that the above-described embodiment of the seat in accordance with the principles of this invention has been set forth solely by way of example thereof and that further modifications and alterations may be made therein without thereby departing from the spirit and scope of the invention.

We claim:

1. A seat comprising a seat carrier means, a seat portion carried on the seat carrier means and adjustable in respect of its inclination, a backrest portion adjustable in respect of its inclination, a first gas spring means having an actuating member and operatively connected to the backrest portion for adjustment of the inclination thereof, at least one second gas spring means having an actuating member and operatively connected to the seat portion for adjustment of the inclination thereof, an actuating lever pivotable about a pivot point in a first direction and in a second direction perpendicular to the first direction, and connecting means operatively connecting the actuating lever to the actuating members of said gas spring means, such that the actuating lever is operable to adjust only the inclination of the backrest portion when the actuating lever is moved in said first direction from a first non-actuating position to a spaced-apart second actuating position, and the actuating lever is operable to adjust only the inclination of the seat portion when the actuating lever is moved in said second direction from a first non-actuating position to a spaced-apart second actuating position, wherein the said actuating lever is adapted to be operated in said first direction when it is in respective ones of said first and second spaced-apart position in said second direction of pivotal movement thereof.

2. A seat as set forth in claim 1 wherein said connecting means comprise a first connecting member between said actuating lever and said actuating member of said first gas spring means, and a pivotable angle lever which has first and second limb portions, the first limb portion extending in said second direction of movement of said actuating lever and said second limb portion extending in said first direction of movement of said actuating lever, said actuating lever being co-operable with said first limb portion displaceably along said first limb portion for actuating the actuating member of said second gas spring means and said second limb portion being co-operable with the actuating member of said first gas spring means.

3. A seat as set forth in claim 2 including two second gas spring means arranged at a spacing from each other between said seat portion and said seat carrier means wherein said connecting means further comprises a second connecting member between said actuating lever and said second gas spring means, a forked element including a shank portion connected to said actuating lever at a spacing from said angle lever, and first and second leg portions, and pivotable elbow levers each having first and second lever arms, each said leg portion of said forked element engaging the first lever arm of a respective elbow lever and said second lever arm of each elbow lever co-operating with the actuating member of a respective second gas spring means.

4. A seat as set forth in claim 3 wherein the pivot axes of said first and second elbow levers are aligned with each other and are mounted to said seat portion.

5. A seat as set forth in claim 2 wherein the pivot axis of said angle lever is mounted to said seat portion and wherein said first gas spring means has first and second end portions, said first end portion is operatively connected to said backrest portion and said second end portion being operatively connected to said seat portion, wherein said first end portion is opposed to said actuating member of the said first gas spring means and wherein said second end portion is adjacent to said actuating member.

* * * * *